US006263677B1

(12) United States Patent
Hafner et al.

(10) Patent No.: US 6,263,677 B1
(45) Date of Patent: Jul. 24, 2001

(54) MULTISTAGE LOW-TEMPERATURE REFRIGERATION MACHINE

(75) Inventors: Hans-Ulrich Hafner, Cologne; Christoph Heiden, Linden; Gunter Thummes, Hamburg, all of (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/155,127

(22) PCT Filed: Jan. 25, 1997

(86) PCT No.: PCT/EP97/00342

§ 371 Date: Sep. 22, 1998

§ 102(e) Date: Sep. 22, 1998

(87) PCT Pub. No.: WO97/37174

PCT Pub. Date: Oct. 9, 1997

(30) Foreign Application Priority Data

Mar. 29, 1996 (DE) ..... 196 12 539

(51) Int. Cl.[7] ..... F25B 9/00
(52) U.S. Cl. ..... 62/6
(58) Field of Search ..... 62/6

(56) References Cited

U.S. PATENT DOCUMENTS

| | | |
|---|---|---|
| 3,721,101 | 3/1973 | Sheppard . |
| 5,152,147 | 10/1992 | Saho . |
| 5,381,666 | 1/1995 | Saho . |
| 5,387,252 | 2/1995 | Nagao . |
| 5,412,952 | 5/1995 | Ohtani . |
| 5,435,136 | 7/1995 | Ishizaki et al. . |
| 5,485,730 | 1/1996 | Herd . |

FOREIGN PATENT DOCUMENTS

| | | |
|---|---|---|
| 4234678 | 4/1993 | (DE) . |
| 448738 | 10/1991 | (EP) . |
| 1442415 | 5/1965 | (FR) . |
| 2301 426 | 12/1996 | (GB) . |

*Primary Examiner*—Corrine McDermott
*Assistant Examiner*—Malik N. Drake
(74) *Attorney, Agent, or Firm*—Wall Marjama & Bilinski

(57) ABSTRACT

The invention relates to a multistage low-temperature refrigeration machine with a first stage in the form of a displacer refrigerator (1) as well as at least one further stage in the form of a pulse tube refrigerator (25); in order to suppress vibrations it is proposed that a flexible component (45) designed to prevent the spread of vibrations be placed between the displacer refrigerator (1) and the pulse tube refrigerator (25).

13 Claims, 2 Drawing Sheets

FIG.1
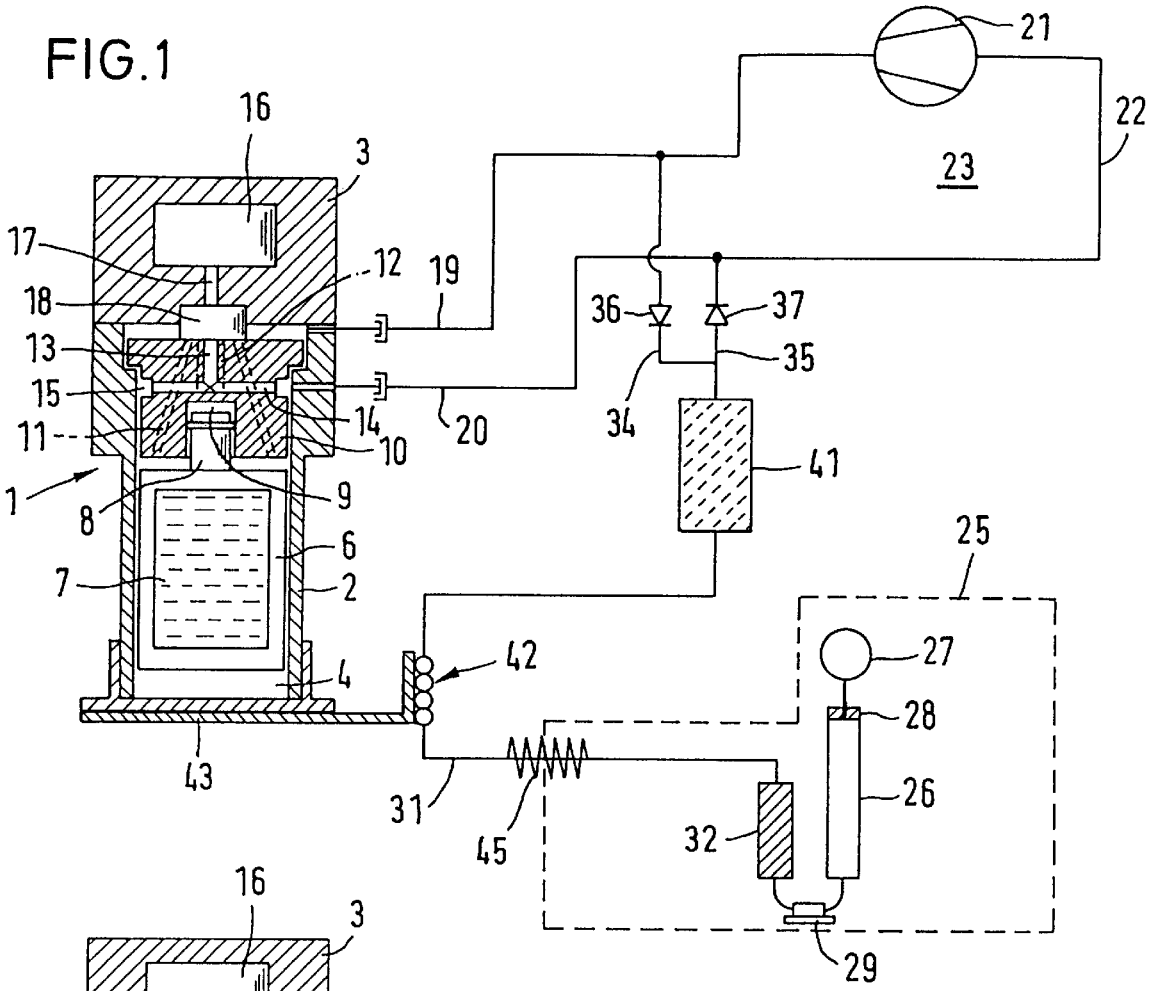
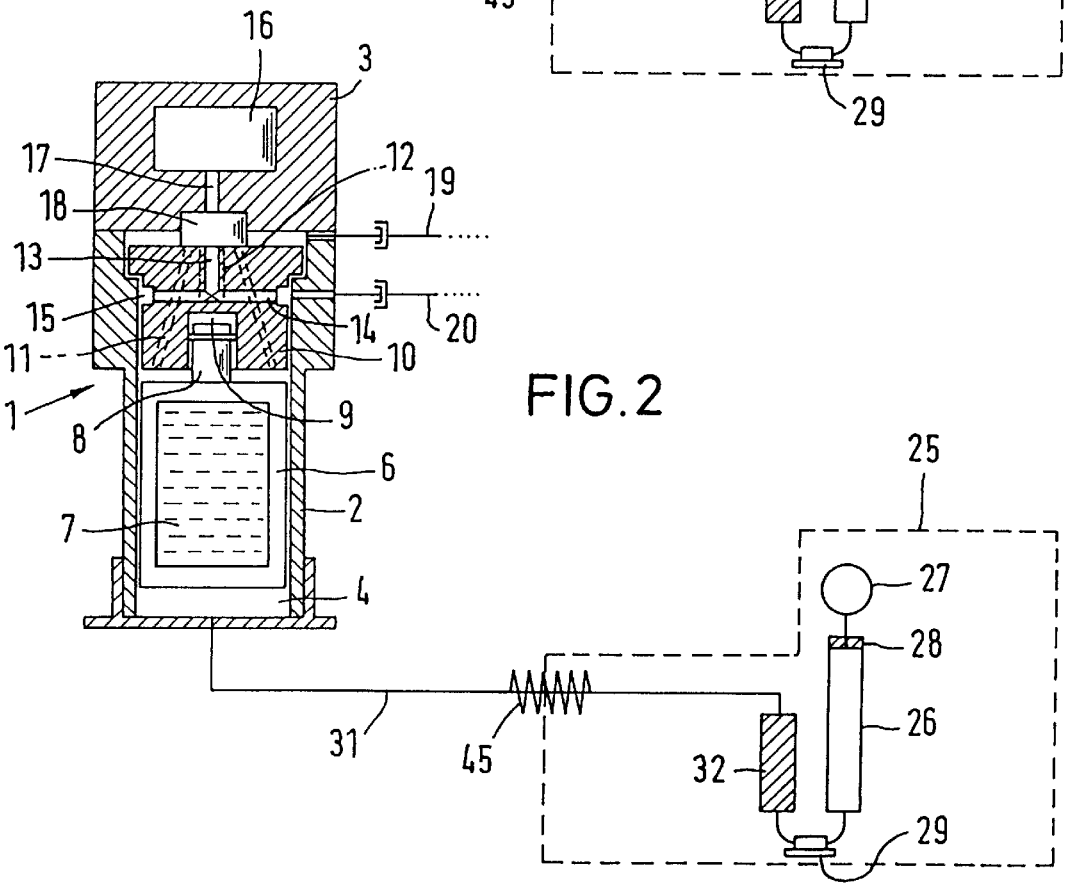
FIG.2

MULTISTAGE LOW-TEMPERATURE REFRIGERATION MACHINE

FIELD OF THE INVENTION

The invention relates to a multistage low-temperature refrigeration machine with a first stage in the form of a displacer refrigerator as well as at least one further stage in the form of a pulse tube refrigerator.

BACKGROUND OF THE INVENTION

The term displacer refrigerator is to be understood as a Gifford McMahon, Sterling or similar refrigeration machine. Single-stage refrigeration machines of this kind have a working area with a displacer. The working area is connected in alternating fashion to a high pressure and a low pressure source of gas in such a manner that during the forced to-and-fro motion of the displacer, a thermodynamic cycle is performed. The working gas is cycled preferably through a regenerator (heat accumulator for pre-cooling of the entering gas) located within the displacer. During operation of the refrigeration machine, heat is removed at one of the two ends of the working area. With a single-stage refrigerator of this kind and with helium as the working gas, temperatures down to 10–30° K. may be generated. Displacer refrigerators offer the advantage of being relatively powerful and their theoretical fundamentals are well understood. Their disadvantage is the generation of vibrations caused by the mass of the displacer as it moves to-and-fro.

Also known are refrigeration machines, the operation of which is based on the principle of the pulse tube. These machines include an area with a fixed refrigerator in which in-flowing gas is cooled by exchanging the heat with the regenerator material, as well as a pulse tube into which the working gas from the area of the regenerator flows in and out periodically at one end (cold side). Connected to the other end (warm side) of the pulse tube, preferably through a constriction, is a sealed volume. By suitably selecting this throttle, the phase relationship between mass flow and pressure variation in the area of the pulse tube may be influenced for the purpose of attaining optimum performance. Besides the above approach detailed (referred to as a "Orifice Pulse Tube" design) other types of design such as ("Double Inlet", "4-valve") also exist that modify the phase relationship. The efficiency of refrigeration machines of these kinds is limited. These designs offer an advantage however, in that they do not generate any vibrations since they do not contain any moving parts.

Through a lecture on occasion of the "Cryogenic Engineering Conference" Columbus, Ohio, in July 1995 it is known to combine a displacement refrigerator with a pulse tube refrigerator. The displacer refrigerator forms the first stage and, the pulse tube refrigerator forms the second stage of a multistage low-temperature refrigeration machine. In order to ensure that the cold end of the displacer refrigerator and the warm end of the pulse tube refrigerator are at the same temperature, a thermal link made from a rigid copper panel is provided which is linked in a thermally well conducting manner to both ends of the refrigerators. Owing to this rigid link, vibrations produced by the displacer refrigerator spread to the pulse tube refrigerator. Thus, this known type of combined refrigeration machine is not suited for cooling vibration sensitive objects.

SUMMARY OF THE INVENTION

It is the task of the present invention to utilize the advantage of the pulse tube refrigerator in which vibrations are not generated, in connection with a combined refrigeration machine of the aforementioned kind, at least in the area of the second stage or subsequent stages.

This task is solved through the present invention by placing a flexible component which prevents the spread of vibrations between the first displacement refrigerator stage and the further stage which is designed as a pulse tube refrigeration stage. Through this measure, the vibrations from the displacement refrigerator can be kept away from the pulse tube refrigerator. The cold end of the further stage operating as a pulse tube refrigerator may thus be linked thermally to vibration sensitive objects or the like without any additional means.

BRIEF DESCRIPTION OF THE DRAWINGS

Further advantages and details of the present invention shall be explained by referring to the design examples presented schematically in the following figures:

FIGS. 1 and 2 illustrate combined refrigeration machines according to the present invention different feeds for the working gas leading to the pulse tube refrigerator.

DETAILED DESCRIPTION OF THE INVENTION

Figure 3:
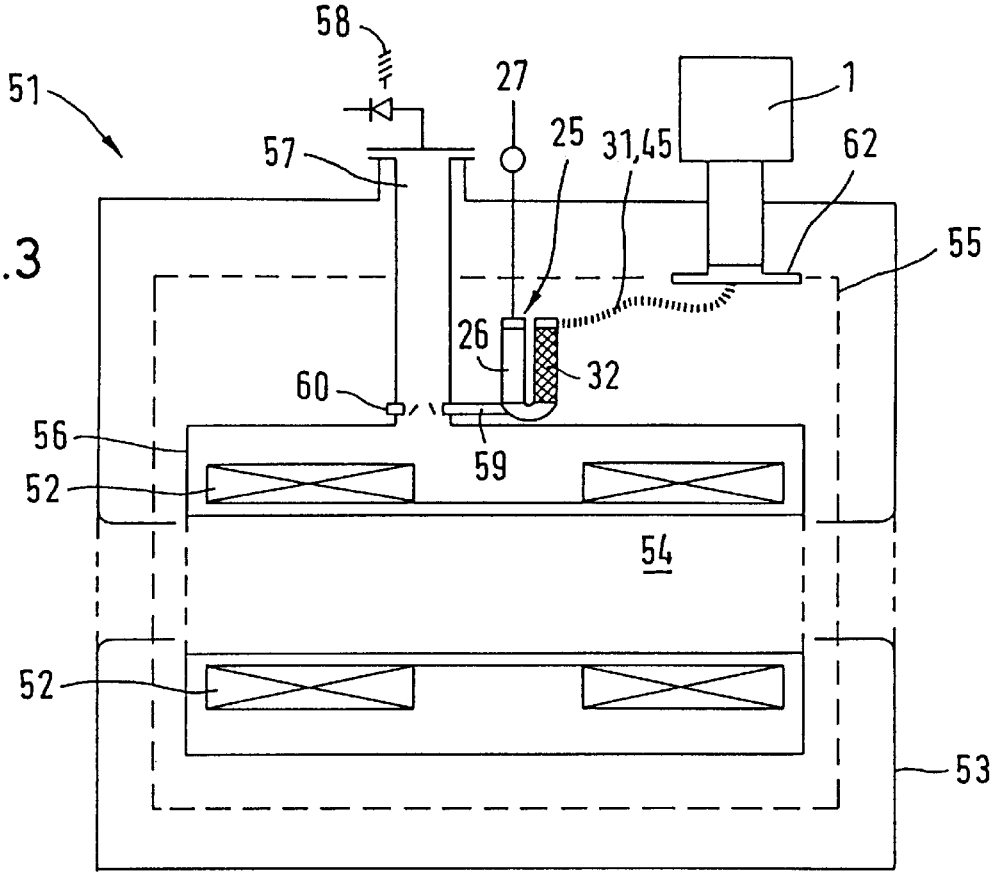
FIG. 3 depicts insertion of a refrigeration machine according to the present invention in a cryostat which serves the purpose of cooling magnets with liquid helium.

The displacement refrigerator 1 presented in FIGS. 1 and 2 has a housing which consists of two housing sections 2 and 3. Housing section 2 houses a cylindrical working area 4 for the displacer 6. Located in displacer 6 is the regenerator 7.

In the case of a pneumatic drive system, the displacer 6 is equipped with a drive piston 8, the corresponding cylinder 9 of which is accommodated in a guide bushing 10 which in turn seals off the working area 4 in the direction of housing section 3. The guide bushing 10 is equipped with bore holes for distributing the high and low pressure gas controlled by a turning valve into the control volume (9) as well as into the actual working area. The bore holes 11 open out into the working area 4 and serve the purpose of supplying this area with the working gas. The bore hole 13 opens into a cross bore 14 which is linked via an annular groove 15 to the outside wall of the guide bushing 10. The low pressure side is connected via this link to the valve controller. Two additional bore holes 12, indicated by dashed lines, are used to pneumatically drive the displacer 6. The additional bore holes 12 extend through planes which differ from the plane of FIGS. 1 and 2 so that they do not cross each other, this being indicated by the dashed lines.

A control motor 16 located within the housing section 3 actuates a control valve 18, via a motor shaft 17. This control valve 18 serves the purpose of supplying the; and working gas, preferably helium, at high and at low pressures to the different bore holes 12 in a manner which is basically known. The working gas is run in a cycle 23 outside refrigerator 1 through the line 22 with the compressor 21. The high pressure connection 19 at the refrigerator 1 is linked with the high pressure side of the compressor 21, and the low pressure connection 20 is linked to the low pressure side of the compressor 21.

The pulse tube refrigerator 25 according to this embodiment comprises a pulse tube 26, having a warm end to which the gas volume 27 is connected with the constriction 28. A cold flange located in the area of a cold end of the pulse tube 26 is designated as 29. The gas is supplied to the pulse tube 26 via line 31 in which the regenerator 32 is located.

In the design example according to FIG. 1, the gas supplied to the pulse tube 26 is taken from the cycle 23 for the working gas with the compressor 21. The gas supply line 31 opens into two separate lines 34 and 35, each which are equipped with a control valve 36 and 37, respectively. The line 34 is linked to the high pressure side of the compressor 21. The control valve 36 is arranged such that the working gas is allowed to flow through the lines 34 and 31 to the pulse tube 26. The line 35 is linked to the low pressure side of the compressor 21. The control valve 37 is arranged such that gas flowing in the reverse direction is allowed to flow through lines 31 and 35 into the cycle 23 with the working gas.

In order to be able to pre-cool the working gas flowing through the pulse tube 26, two heat exchangers 41 and 42 are provided. The first heat exchanger 41, preferably of the regenerative type, is interspersed by the working gas flowing to-and-fro. The gas flowing back from the pulse tube 26 into the cycle 23 for the working gas pre-cools the gas flowing in the direction of the pulse tube 26. The second heat exchanger 42 is linked via a thermal link 43 to the cold end of the displacer refrigerator 1. In the heat exchanger 42, the gas flowing in the direction of the pulse tube refrigerator 25 is cooled down to the temperature of the cold end of displacer refrigerator 1.

In the design example according to FIG. 2, the gas supply line 31 opens into the area of the cold end of the displacer refrigerator 1 that is into the working area 4. The working gas is supplied to the pulse tube refrigerator 25 directly from the cold section of the displacer refrigerator 1. Compared to the design according to drawing FIG. 1, this design has the advantage of being simpler, but with the disadvantage that the cycle frequency (high pressure/low pressure switching) for the displacer machine and the pulse tube section is always identical, which can be a hindrance in attaining an optimum refrigeration capacity at both stages.

In order to avoid the spread of vibrations produced by the displacer refrigerator 1 to the pulse tube refrigerator 25, the line 31, in the case of both design examples, is equipped with a flexible component 45. This component may be, for example, a section of metallic (stainless steel) corrugated tube. Alternately, a hose section made from plastic may be employed. In the design example according to FIG. 1 thermal link 43 can also be made to be flexible so as to prevent the spread of vibrations.

In the case of a third alternative, not shown, the two machines 1 and 25 are operated with separate compressors. For example, by employing a linear compressor for the pulse tube machine, the valve control can be omitted. As in the preceding, the vibrations may be decoupled by means of a flexible component.

Figure 4:
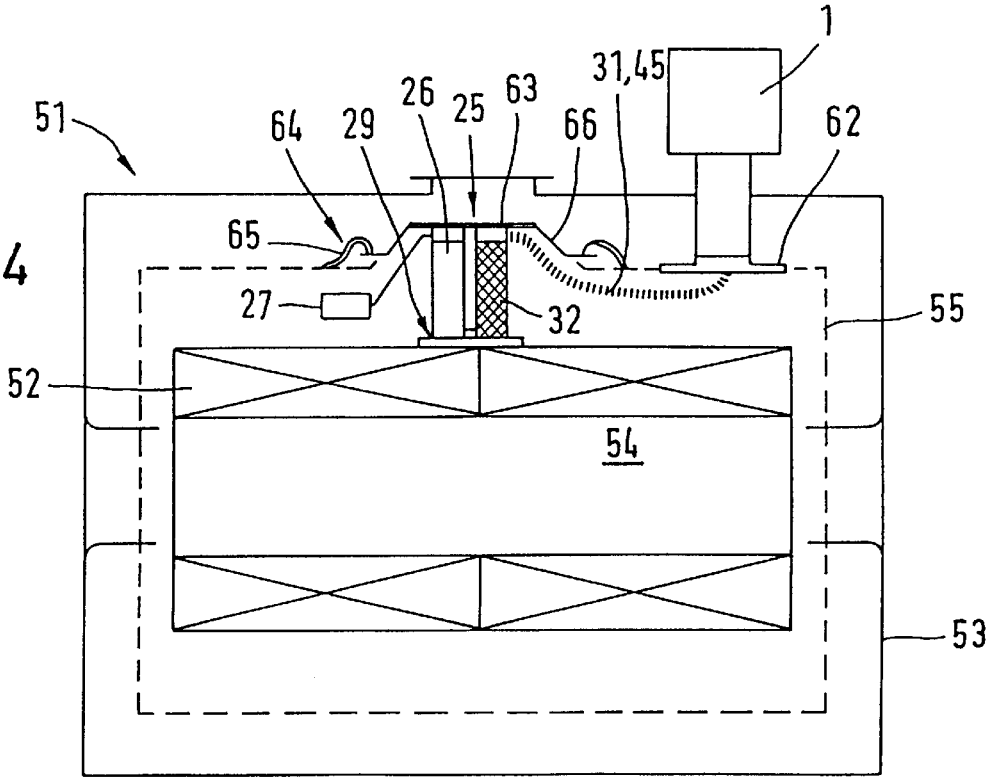
FIG. 4 illustrates a cryostat with a refrigeration machine according to the present invention in which the magnets are cooled directly.

FIGS. 3 and 4 depict application examples of two cryostats equipped with a refrigeration machine according to the present invention. The cryostats the purpose of cooling superconducting magnets 52. Other items where cooling with liquid helium or direct cooling may be employed are, for example:

superconducting feeders and wires, superconducting (Josephson) switching components, sensors which need to be cooled (because they are superconducting or to reduce noise), electronics components which need to be cooled (to reduce noise), cryopump arrangements.

In the design examples presented, the magnets 52 which need to be cooled are arranged in a circle within the housing of the cryostat 53 and surround a central analysis chamber 54. Located between the magnets 52 and the outer housing of the cryostat 53 is a thermal screening stage formed by a thermal radiation shield 55.

In the design example according to FIG. 3, the magnets 52 are accommodated in a tank 56 of a circular cross section filled with a refrigerant, preferably helium. The tank's helium filling port 57 is equipped with a safety valve 58. Is the task of the presently described refrigeration machines 1, 25 to maintain the helium in the tank at a temperature of about 4.2° K. (boiling point of the refrigerant), so as to prevent the refrigerant from evaporating or to recover any evaporated refrigerant by means of condensation. To enable this tanks, the cold end of the pulse tube 26 is thermally coupled via a thermal link 59 to the filling port 57. The coupling point 60 is located in the immediate vicinity of the opening of the filling port 57 in tank 56, so that it is located below the surface of the liquid helium. The cold end of the displacer refrigerator 1 is equipped with a cold flange 62 which is thermally coupled to the thermal radiation shield 55 so that it attains a temperature of 30 to 100 K. The pulse tube refrigerator 25 is supplied with gas from the cold end of the working area 4 of the displacer refrigerator 1 (FIG. 2) so that the temperature at both ends is approximately equal. The gas supply line 31 leading from the cold end of the displacer refrigerator 1 to the warm end of the pulse tube refrigerator 25 is a metallic section of highly flexible corrugated hose and thus forms the desired flexible coupling 45.

In the design example according to FIG. 4, a helium tank is not present. The cold end of the pulse tube refrigerator 25 is thermally linked directly via a cold flange 29 to the magnets 52. In particular, this application makes sense when the superconducting material of the magnets 52 permits higher temperatures (5 to 10 K). In this design, the pulse tube refrigerator 25 is supplied with gas from the cold end of the working area 4 of the displacer refrigerator 1. The gas supply line 31 consisting of a section of corrugated hose, forming the flexible coupling 45.

In the design example according to FIG. 4, also the warm end of the pulse tube refrigerator 25 is also coupled to the thermal radiation shield 55 (via thermal link 63) in addition to the cold end of the displacer refrigerator 1. The formation of equal temperatures at both these ends is thus facilitated. For this purpose, also the regenerator 32, with its side facing away from the pulse tube 26, is thermally linked to the thermal link 63.

In order to prevent the spread of vibrations generated by the displacer refrigerator 1 via the thermal radiation shield 55 to the pulse tube refrigerator, an additional flexible coupling 64 is provided between the thermal link 63 and the thermal radiation shield. The coupling 64 comprises metallic straps 65, preferably made of copper, which are in good thermal contact with the thermal radiation shield 55 and a flange 66 at the thermal link 63.

What is claimed is:

1. A multistage low-temperature refrigeration machine comprising a first stage in the form of a displacer refrigerator; at least one additional stage in the form of a pulse tube refrigerator; and a flexible component located between the displacer refrigerator and the pulse tube refrigerator, for preventing the spread of vibrators between said stages wherein the flexible component is part of a gas supply line for the pulse tube refrigerator and in which a working gas is supplied to the pulse tube refrigerator via said gas supply line, said gas supply line being linked to a cycle of the working gas for the displacer refrigerator.

2. A machine according to claim 1, wherein the flexible component is a metallic section of corrugated hose.

3. A machine according to claim 1, wherein the flexible component is a section consisting of plastic hose.

4. A machine according to claim 1, wherein the gas supply line is connected via a pair of separate lines to the high pressure side and low pressure sides, respectively, of a compressor, said compressor being contained in the cycle for the working gas.

5. A machine according to claim 1, including a regenerative heat exchanger disposed between the pulse tube refrigerator and the cycle of the working gas for the displacer refrigerator.

6. A machine according to claim 1 including a heat exchanger disposed along said gas supply line, said heat exchanger being coupled thermally to a cold end of the displacer refrigerator.

7. A machine according to claim 6, including a thermal link for linking the cold end of the displacer, said thermal link being flexible.

8. A machine according to claim 1, wherein said pulse tube refrigerator includes a pulse tube, said machine including a regenerator disposed within said gas supply line in which a warm end of said pulse tube and an end of the regenerator facing away from the pulse tube are thermally linked to each other.

9. A cryostat used in conjunction with a multistage low-temperature refrigeration machine, said cryostat having a housing for retaining an object to be cooled, said machine comprising a first stage in the form of a displacer refrigerator, at least one additional stage in the form of a pulse tube refrigerator, and a flexible component located between the displacer refrigerator and the pulse tube refrigerator for preventing the spread of vibrations between said stages, said cryostat including a shielding stage thermally coupled to at least one of a cold end of the displacer refrigerator and a warm end of the pulse tube refrigerator, and in which the object to be cooled is thermally coupled to a cold end of the pulse tube refrigerator wherein the object to be cooled is a tank filled with liquid helium, and in which the cold end of the pulse tube refrigerator is thermally coupled to a helium re-filling port of the tank.

10. A multistage low-temperature refrigeration machine comprising a first stage in the form of a displacer refrigerator; at least one additional stage in the form of a pulse tube refrigerator; and a flexible component located between the displacer refrigerator and the pulse tube refrigerator, for preventing the spread of vibrators between said stages, and in which the flexible component is part of a gas supply line for the pulse tube refrigerator, wherein the gas supply line is connected to a cold end of a working area defined within said displacer refrigerator.

11. A cryostat used in conjunction with a multistage low-temperature refrigeration machine, said cryostat having a housing for retaining an object to be cooled, said machine comprising a first stage in the form of a displacer refrigerator, at least one additional stage in the form of a pulse tube refrigerator, and a flexible component located between the displacer refrigerator and the pulse tube refrigerator for preventing the spread of vibrations between said stages, said cryostat including a shielding stage thermally coupled to at least one of a cold end of the displacer refrigerator and a warm end of the pulse tube refrigerator, and in which the object to be cooled is thermally coupled to a cold end of the pulse tube refrigerator, wherein said shielding stage includes a thermal link portion for linking with the warm end of the pulse tube refrigerator, and a second flexible component for preventing the spread of vibrations, said second flexible component being provided between the thermal link portion and the remainder of the shielding stage.

12. A cryostat according to claim 11, wherein said second flexible component consists of a plurality of upper strips.

13. A cryostat used in conjunction with a multistage low-temperature refrigeration machine, said cryostat having a housing for retaining an object to be cooled, said machine comprising a first stage in the form of a displacer refrigerator, at least one additional stage in the form of a pulse tube refrigerator, and a flexible component located between the displacer refrigerator and the pulse tube refrigerator for preventing the spread of vibrations between said stages, said cryostat including a shielding stage thermally coupled to at least one of a cold end of the displacer refrigerator and a warm end of the pulse tube refrigerator, and in which the object to be cooled is thermally coupled to a cold end of the pulse tube refrigerator wherein, the object to be cooled is a magnet made of a superconducting material wherein the warm end of the pulse tube thermometer is coupled to the shielding stage in addition to the cold end of the displacer refrigerator.

* * * * *